US012121957B1

(12) United States Patent
Zhang et al.

(10) Patent No.: US 12,121,957 B1
(45) Date of Patent: Oct. 22, 2024

(54) METHOD FOR IMPROVING SMOOTH RUNNING OF CASTING OF RARE EARTH STAINLESS STEEL USING PULSE CURRENT

(71) Applicant: Inner Mongolia University of Science & Technology, Baotou (CN)

(72) Inventors: Xinfang Zhang, Baotou (CN); Mengcheng Zhou, Baotou (CN); Chengbao Liu, Baotou (CN); Changhao Liu, Baotou (CN); Zhiyong Chen, Baotou (CN); Baoyu Zhang, Baotou (CN); Xiaoshan Huang, Baotou (CN); Yulong Chen, Baotou (CN); Zhongxue Wang, Baotou (CN); Heng Ma, Baotou (CN); Yubao Liu, Baotou (CN); Dandan Zhang, Baotou (CN)

(73) Assignee: Inner Mongolia University of Science & Technology, Baotou (CN)

( * ) Notice: Subject to any disclaimer, the term of this patent is extended or adjusted under 35 U.S.C. 154(b) by 0 days.

(21) Appl. No.: 18/731,158

(22) Filed: May 31, 2024

(30) Foreign Application Priority Data

Feb. 19, 2024 (CN) ..... 202410182692.X

(51) Int. Cl.
*B22D 11/11* (2006.01)
*B22D 11/00* (2006.01)

(52) U.S. Cl.
CPC ..... *B22D 11/11* (2013.01); *B22D 11/002* (2013.01)

(58) Field of Classification Search
CPC ..... B22D 11/00; B22D 11/002; B22D 11/11
USPC ..... 164/466, 467, 468, 502, 503, 504
See application file for complete search history.

(56) References Cited

FOREIGN PATENT DOCUMENTS

CN 107812902 A * 3/2018 ..... B22D 11/11
CN 107999718 A * 5/2018 ..... B22D 11/11

OTHER PUBLICATIONS

Machine translation of CN 107812902 A (Year: 2018).*
Machine translation of CN 107999718 A (Year: 2018).*

* cited by examiner

*Primary Examiner* — Kevin P Kerns

(57) ABSTRACT

A method for improving smooth running of casting of rare earth stainless steel using pulse current includes the following steps: setting corresponding initial pulse voltage, pulse current, and pulse frequency in accordance with difference of rare earth element content in molten steel; and adjusting the pulse voltage, pulse current, and pulse frequency according to position change of stopper rod until the end of continuous casting. The method can stably improve the clogging of immersion nozzle during continuous casting, the smooth running of continuous casting and production efficiency, and decrease production cost.

3 Claims, No Drawings

METHOD FOR IMPROVING SMOOTH RUNNING OF CASTING OF RARE EARTH STAINLESS STEEL USING PULSE CURRENT

CROSS-REFERENCE TO RELATED APPLICATIONS

This application claims priority to Chinese Patent Application No. 202410182692.X with a filing date of Feb. 19, 2024. The content of the aforementioned application, including any intervening amendments thereto, is incorporated herein by reference.

TECHNICAL FIELD OF THE INVENTION

The disclosure relates to the technical field of continuous casting of metallurgy, in particular to a method for improving smooth running of the casting of rare earth stainless steel by pulse current.

BACKGROUND OF THE INVENTION

Rare earth elements are highly reactive and readily combined with oxygen, sulfur and other elements in the molten steel to form rare earth oxides, rare earth sulfides, or rare earth oxysulfides. However, when casting the rare earth-containing steel, the refractory materials of immersion nozzle are prone to erosion by the molten steel. Subsequently, rare earth inclusions accumulate at the erosion sites to form a base, increasing the wetting interface, causing continuous agglomeration and growth of inclusions at the base, resulting in local turbulence in the molten steel. This accelerates the growth of inclusions, creating a vicious cycle that eventually leads to nozzle blockage, impeding casting. Especially when casting of high rare earth content stainless steel, nozzle blockage leads to uneven casting, resulting in incomplete pouring of ladles, severely affecting production efficiency, and increasing production costs.

In recent years, various measures have been taken to address casting irregularities, such as argon blowing in tundishes, modifying the structure of immersion nozzles, and adjusting the composition of refractory materials. However, the problem of nozzle blockage during casting of rare earth-containing steel has not been effectively resolved. In recent years, with the continuous development of electromagnetic metallurgical technology, applying an electrical field to suppress nozzle blockage has become a hot research topic. Some studies suggests that chemical reaction at the interface between immersion nozzle and molten steel generate charges, and friction between the molten steel, the immersion nozzle, and inclusions also generates charges.

Rare earth oxides carry a positive charge, while immersion nozzle carry a negative charge. Therefore, applying a pulsed external filed to eliminate the interface electric field can improve immersion nozzle blockage. However, the effectiveness of the above-mentioned method in improving immersion nozzle blockage during casting of molten steels with different rare earth contents is unstable.

SUMMARY OF THE INVENTION

In order to solve the problems of the above-mentioned prior art, the main object of the present disclosure to provide a method for improving the smooth running of casting rare earth stainless steel using pulse current.

In order to achieve the above object, according to one aspect of the present disclosure, the following technical solution is provided.

A method for improving smooth running of casting of rare earth stainless steel using pulse current, including the following steps:

S1, after a molten steel enters a crystallizer from an immersion nozzle and solidifies into a billet, when the continuous casting pulling speed stabilizes, applying a pulse electric field to the molten steel in a tundish.

S2, setting an initial pulse voltage, an initial pulse current, and an initial pulse frequency in accordance with a rare earth element content in molten steel.

S3, adjusting the pulse voltage, the pulse current, and the pulse frequency in real-time according to a position change of a stopper rod during continuous casting until the continuous casting is complete, and then terminating the pulse electric fields.

As a preferred embodiment of the method for improving the smooth running of the casting of rare earth stainless steel using pulse current according to the present disclosure, the material of the immersion nozzle in the step S1 is aluminum-carbon, aluminum-silicon-zirconium-carbon, or aluminum-zirconium-carbon.

As a preferred embodiment of the method for improving the smooth running of the casting of rare earth stainless steel using pulse current according to the present disclosure, the rare earth element content in the step S2 is 100-500 ppm.

As a preferred embodiment of the method for improving the smooth running of the casting of rare earth stainless steel using pulse current according to the present disclosure, the rare earth element in the step S2 is one or more of lanthanum, cerium, neodymium, and yttrium.

As a preferred embodiment of the method for improving the smooth running of the casting of rare earth stainless steel using pulse current according to the present disclosure, in the step S2, the pulse voltage is 10-100 V, the pulse current is 20-500 A, and the pulse frequency is 1,000-100,000 Hz.

As a preferred embodiment of the method for improving the smooth running of the casting of rare earth stainless steel using pulse current according to the present disclosure, the specific details of setting an initial pulse voltage, an initial pulse current and an initial pulse frequency in accordance with the rare earth element content in the molten steel in the step S2 are as follows.

When the rare earth element content is 100-200 ppm, the initial pulse voltage is 10-20 V, the initial pulse current is 20-100 A and the initial pulse frequency is 1000-5,000 Hz.

When the rare earth element content is 200-300 ppm, the initial pulse voltage is 20-40 V, the initial pulse current is 60-140 A and the initial pulse frequency is 5,000-10,000 Hz.

When the rare earth element content is 300-400 ppm, the initial pulse voltage is 40-60 V, the initial pulse current is 100-250 A and the initial pulse frequency is 5,000-40,000 Hz.

When the rare earth element content is 400-500 ppm, the initial pulse voltage is 60-100 V, the initial pulse current is 200-500 A and the initial pulse frequency is 10,000-100,000 Hz.

As a preferred embodiment of the method for improving the smooth running of the casting of rare earth stainless steel using pulse current according to the present disclosure, the specific details of adjusting the pulse voltage, the pulse current and the pulse frequency in real-time according to the position change of the stopper rod during continuous casting in the step S2 are as follows:

When the content of rare earth elements in molten steel is 100-300 ppm, the pulse voltage, pulse current and pulse frequency increase by 30-50% when the position of the stopper rod rises by more than 6 mm within 20 min. When the position of the stopper rod rises by more than 8 mm within 40 min, the pulse voltage, pulse current and pulse frequency all increase by 40-80%;

When the content of rare earth elements in molten steel is 300-400 ppm, the pulse voltage, pulse current and pulse frequency increase by 20-40% when the position of the stopper rod rises by more than 6 mm within 25 minutes. When the position of the stopper rod rises by more than 8 mm within 40 minutes, the pulse voltage, pulse current and pulse frequency all increase by 30-50%;

When the content of rare earth elements in molten steel is 400-500 ppm, the pulse voltage, pulse current and pulse frequency increase by 20% when the position of the stopper rod rises by more than 6 mm within 25 minutes. When the position of the stopper rod rises by more than 8 mm within 40 minutes, the pulse voltage, pulse current, and pulse frequency are all increased to the upper parameter range.

The advantages of the present invention are as follows:

The present invention provides a method for improving smooth running of casting of rare earth stainless steel using pulse current. An initial pulse voltage, an initial pulse current and an initial pulse frequency are set in accordance with content of rare earth element in molten steel. The pulse voltage, the pulse current and the pulse frequency are adjusted in real-time in accordance with a position change of a stopper rod during continuous casting until the continuous casting is complete. The method according to the present disclosure effectively stabilizes and improves the blockage situation of immersion nozzles during casting of molten steels with different rare earth content, thereby enhancing the smoothness of rare earth stainless steel casting, increasing production efficiency, and reducing production costs.

DETAILED DESCRIPTION OF THE INVENTION

A clear and complete description will be made below in conjunction with the technical solutions in the embodiments. Apparently, the described embodiments are only some of the embodiments of the present invention, but not all of them. Based on the embodiments of the present invention, all other embodiments obtained by persons of ordinary skill in the art without inventive efforts fall within the protection scope of the present invention.

During the casting of rare earth stainless steel, traditional methods to improve smooth running, such as altering the structure and composition of immersion nozzles, adding calcium treatment processes, argon blowing stirring, etc., have limited effectiveness. Additionally, the method of treating with a pulsed electric field shows unstable improvement effects on nozzle blockage during casting of molten steels with different rare earth contents. The present disclosure provides a method for improving smooth running of casting of rare earth stainless steel using pulse current.

According to one aspect of the present disclosure, the present disclosure provides following technical solutions:

A method for improving smooth running of casting of rare earth stainless steel using pulse current, comprises the following steps:

S1, after a molten steel enters a crystallizer from an immersion nozzle and solidifies into a billet, when the continuous casting pulling speed stabilizes, applying a pulse electric filed to the molten steel in a tundish;

S2, setting an initial pulse voltage, an initial pulse current and an initial pulse frequency in accordance with rare earth element content in the molten steel, S3, according to a position change of a stopper rod during continuous casting, adjusting the pulse voltage, the pulse current and the pulse frequency in real-time until the continuous casting is complete, and then terminating the pulse electric field.

Preferably, the material of the immersion nozzle in the step S1 is aluminum-carbon, aluminum-silicon-zirconium-carbon, or aluminum-zirconium-carbon.

Preferably, the rare earth element content in the step S2 is 100-500 ppm.

Preferably, the rare earth element in the step S2 is one or more of lanthanum, cerium, neodymium, and yttrium.

Preferably, in the step S2, the pulse voltage is 10-100 V, the pulse current is 20-500 A, and the pulse frequency is 1,000-100,000 Hz.

Preferably, the specific details of setting an initial pulse voltage, an initial pulse current and an initial pulse frequency in accordance with the rare earth element content of the molten steel in the step S2 are as follows:

When the rare earth element content is 100-200 ppm, the initial pulse voltage is 10-20 V, the initial pulse current is 20-100 A and the initial pulse frequency is 1000-5,000 Hz;

When the rare earth element content is 200-300 ppm, the initial pulse voltage is 20-40 V, the initial pulse current is 60-140 A and the initial pulse frequency is 5000-10,000 Hz;

When the rare earth element content is 300-400 ppm, the initial pulse voltage is 40-60 V, the initial pulse current is 100-250 A and the initial pulse frequency is 5,000-40,000 Hz;

When the rare earth element content is 400-500 ppm, the initial pulse voltage is 60-100 V, the initial pulse current is 200-500 A and the initial pulse frequency is 10,000-100,000 Hz.

As a preferred embodiment of the method for improving the smooth running of the casting of rare earth stainless steel by pulse current according to the present disclosure, the specific details of adjusting the pulse voltage, the pulse current and the pulse frequency in real time according to the position change of the stopper rod during continuous casting in the step S2 are as follows:

When the content of the rare earth in molten steel is 100-300 ppm, the pulse voltage, pulse current and pulse frequency increase by 30-50% when the position of the stopper rod rises by more than 6 mm within 20 minutes. When the position of the stopper rod rises by more than 8 mm within 40 minutes, the pulse voltage, pulse current and pulse frequency all increase by 40-80%.

When the content of the rare earth in molten steel is 300-400 ppm, the pulse voltage, pulse current and pulse frequency increase by 20-40% when the position of the stopper rod rises by more than 6 mm within 25 minutes. When the position of the stopper rod rises by more than 8 mm within 40 minutes, the pulse voltage, pulse current and pulse frequency all increase by 30-50%.

When the content of the rare earth in molten steel is 400-500 ppm, the pulse voltage, pulse current and pulse frequency increase by 20% when the position of the stopper rod rises by more than 6 mm within 25 minutes. When the position of the stopper rod rises by more than 8 mm within 40 minutes, the pulse voltage, pulse current and pulse frequency are all increased to the upper parameter range.

The technical solutions of the present invention will be further described below in conjunction with specific examples.

Example 1

A method for improving smooth running of casting of rare earth stainless steel using pulse current is disclosed. In the method the cast steel was 316 stainless steel, with a ladle steel capacity of 80 tons. Rare earth alloy was added to the ladle after refining procedure, resulting in a rare earth element content of 180 ppm upon reaching the continuous casting platform. The method includes the following steps:

S1, after a molten steel enters a crystallizer from an immersion nozzle and solidifies into a billet, when the continuous casting speed stabilizes, a pulsed electric field was applied to the molten steel in a tundish;

S2, the initial pulse voltage to 18 V, the initial pulse current was set to 80 A, and the initial pulse frequency to 3,000 Hz in accordance with the rare earth element content in the molten steel;

S3, according to a position change of a stopper rod during continuous casting, the pulse voltage, the pulse current and the pulse frequency were adjusted in real-time until the continuous casting was complete, and then the pulse electric fields were terminated. At the 12th minute of casting, the increase in the stopper rod position exceeded 6 mm, the pulse voltage was adjusted to 24 V, the pulse current to 110 A, and the pulse frequency to 4,000 Hz. Subsequently, the increase in the stopper rod position slowed down, and the liquid level remained stable. At the 25th minute of casting, the increase in the stopper rod the position of the stopper rod exceeded 8 mm, the pulse voltage was adjusted to 28 V, the pulse current to 120 A and the pulse frequency to 5,000 Hz. Finally, the ladle was completely poured, and no remaining steel in the tundish.

Example 2

A method for improving smooth running of casting of rare earth stainless steel using pulse current is disclosed. In the method the cast steel was 253 stainless steel, with a ladle steel capacity of 100 tons. Rare earth alloy was added to the ladle after refining procedure, resulting in a rare earth element content of 250 ppm upon reaching the continuous casting platform. The method includes the following steps:

S1, after a molten steel enters a crystallizer from an immersion nozzle and solidifies into a billet, when the continuous casting pulling speed stabilizes, a pulsed electric field was applied to the molten steel in a tundish;

S2, the initial pulse voltage to 30 V, the initial pulse current was set to 120 A, and the initial pulse frequency to 10,000 Hz in accordance with the rare earth element content in the molten steel;

S3, according to a position change of a stopper rod during continuous casting, the pulse voltage, the pulse current and the pulse frequency were adjusted in real-time until the continuous casting was complete, and then the pulse electric fields were terminated. At the 15th minute of casting, the increase in the stopper rod position exceeded 6 mm, the pulse voltage was adjusted to 40 V, the pulse current to 160 A, and the pulse frequency to 13,000 Hz. Subsequently, the increase in the stopper rod position slowed down, and the liquid level remained stable. At the 22th minute of casting, the increase in the stopper rod the position of the stopper rod exceeded 8 mm, the pulse voltage was adjusted to 50 V, the pulse current to 200 A and the pulse frequency to 16,000 Hz. Finally, the ladle was completely poured, and no remaining steel in the tundish.

Example 3

A method for improving smooth running of casting of rare earth stainless steel using pulse current is disclosed. In the method the cast steel was 304 stainless steel, with a ladle steel capacity of 80 tons. Rare earth alloy was added to the ladle after refining procedure, resulting in a rare earth element content of 330 ppm upon reaching the continuous casting platform. The method includes the following steps:

S1, after a molten steel enters a crystallizer from an immersion nozzle and solidifies into a billet, when the continuous casting pulling speed stabilizes, a pulsed electric field was applied to the molten steel in a tundish;

S2, the initial pulse voltage to 40 V, the initial pulse current was set to 200 A, and the initial pulse frequency to 20,000 Hz in accordance with the rare earth element content in the molten steel;

S3, according to a position change of a stopper rod during continuous casting, the pulse voltage, the pulse current and the pulse frequency were adjusted in real-time until the continuous casting was complete, and then the pulse electric fields were terminated. At the 18th minute of casting, the increase in the stopper rod position exceeded 6 mm, the pulse voltage was adjusted to 50 V, the pulse current to 250 A, and the pulse frequency to 24,000 Hz. Subsequently, the increase in the stopper rod position slowed down, and the liquid level remained stable. At the 29th minute of casting, the increase in the stopper rod the position of the stopper rod exceeded 8 mm, the pulse voltage was adjusted to 60 V, the pulse current to 280 A and the pulse frequency to 28,000 Hz. Finally, the ladle was completely poured, and no remaining steel in the tundish.

Example 4

A method for improving smooth running of casting of rare earth stainless steel using pulse current is disclosed. In the method the cast steel was 253 stainless steel, with a ladle steel capacity of 90 tons. Rare earth alloy was added to the ladle after refining procedure, resulting in a rare earth element content of 380 ppm upon reaching the continuous casting platform. The method includes the following steps:

S1, after a molten steel enters a crystallizer from an immersion nozzle and solidifies into a billet, when the continuous casting pulling speed stabilizes, a pulsed electric field was applied to the molten steel in a tundish;

S2, the initial pulse voltage to 50 V, the initial pulse current was set to 200 A, and the initial pulse frequency to 30,000 Hz in accordance with the rare earth element content in the molten steel;

S3, according to a position change of a stopper rod during continuous casting, the pulse voltage, the pulse current and the pulse frequency were adjusted in real-time until the continuous casting was complete, and then the pulse electric fields were terminated. At the 20th minute of casting, the increase in the stopper rod position exceeded 6 mm, the pulse voltage was adjusted to 65 V, the pulse current to 250 A, and the pulse frequency to 36,000 Hz. Subsequently, the increase in the stopper rod position slowed down, and the liquid level remained stable. At the 33th minute of casting, the increase in the stopper rod the position of the stopper rod exceeded 8 mm, the pulse voltage was adjusted to 70 V, the pulse current to 270 A and the pulse frequency to 42,000 Hz. Finally, the ladle was completely poured, and no remaining steel in the tundish.

Example 5

A method for improving smooth running of casting of rare earth stainless steel using pulse current is disclosed. In the method the cast steel was 253 stainless steel, with a ladle steel capacity of 80 tons. Rare earth alloy was added to the ladle after refining procedure, resulting in a rare earth element content of 460 ppm upon reaching the continuous casting platform. The method includes the following steps:

S1, after a molten steel enters a crystallizer from an immersion nozzle and solidifies into a billet, when the continuous casting pulling speed stabilizes, a pulsed electric field was applied to the molten steel in a tundish;

S2, the initial pulse voltage to 60 V, the initial pulse current was set to 300 A, and the initial pulse frequency to 50,000 Hz in accordance with the rare earth element content in the molten steel;

S3, according to a position change of a stopper rod during continuous casting, the pulse voltage, the pulse current and the pulse frequency were adjusted in real-time until the continuous casting was complete, and then the pulse electric fields were terminated. At the 18th minute of casting, the increase in the stopper rod position exceeded 6 mm, the pulse voltage was adjusted to 72 V, the pulse current to 360 A, and the pulse frequency to 60,000 Hz. Subsequently, the increase in the stopper rod position slowed down, and the liquid level remained stable. At the 36th minute of casting, the increase in the stopper rod the position of the stopper rod exceeded 8 mm, the pulse voltage was adjusted to 100 V, the pulse current to 500 A and the pulse frequency to 100,000 Hz. Finally, the ladle was completely poured, and no remaining steel in the tundish.

Comparative Example 1

A method for improving smooth running of casting of rare earth stainless steel using pulse current is disclosed. In the method the cast steel was 316 stainless steel, with a ladle steel capacity of 80 tons. Rare earth alloy was added to the ladle after refining procedure, resulting in a rare earth element content of 180 ppm upon reaching the continuous casting platform. The method includes the following steps:

after a molten steel enters a crystallizer from an immersion nozzle and solidifies into a billet, when the continuous casting speed stabilizes, a pulsed electric field was applied to the molten steel in a tundish; the pulse voltage was set to 10 V, the pulse current to 10 A, and the initial pulse frequency to 500 Hz.

This comparison does not set pulse parameters based on the rare earth element content, nor does it adjust pulse parameters based on changes in the stopper rod position. At the beginning of casting, there is significant fluctuation in the stopper rod, resulting in incomplete pouring of steel in the ladle, and 10 tons of remaining steel in the tundish.

Comparative Example 2

A method for improving smooth running of casting of rare earth stainless steel using pulse current is disclosed. In the method, the steel was 316 stainless steel, with a ladle steel capacity of 80 tons. Rare earth alloy was added to the ladle after refining procedure, resulting in a rare earth element content of 180 ppm upon reaching the continuous casting platform. The method includes the following steps:

S1, after a molten steel enters the crystallizer from an immersion nozzle and solidifies into a billet, when the continuous casting pulling speed stabilizes, a pulse electric field was applied to the molten steel in a tundish.

S2, the pulse voltage was set based on the rare earth element content in the molten steel. The pulse voltage was set to 18 V, the pulse current to 80 A, and the pulse frequency to 3,000 Hz, until the casting was complete.

The pulse parameters were set in this comparative example in accordance with the rare earth element content in the molten steel, but the pulse parameters were not adjusted in accordance with the changes in the stopper rod position. Finally, molten steel the ladle steel was not completely poured, with 4 tons of remaining steel in the tundish.

It can be seen from the above-mentioned examples and comparative examples that the corresponding initial pulse voltage, pulse current and pulse frequency were set in accordance with the rare earth element content in the molten steel in the present disclosure, and at the same time, the pulse voltage, pulse current and pulse frequency were adjusted in the real-time until the end of the continuous casting according to the position change of the stopper rod during the continuous casting. The method of the present disclosure stabilizes the improvement of the immersion nozzle blockage situation during casting of molten steels with different rare earth contents, improves the smooth running of rare earth stainless steel casting, enhances production efficiency, and reduces production costs.

The above description is only a preferred embodiment of the present invention, and does not limit the patent scope of the present invention. Under the inventive concept of the present invention, the equivalent structural transformation made by using the content of the description of the present invention, or directly/indirectly used in other related all technical fields are comprised in the patent protection scope of the present invention.

What is claimed is:

1. A method for improving running of casting of rare earth stainless steel using pulse current, comprising the following steps:

S1, after a molten steel enters a crystallizer from an immersion nozzle and solidifies into a billet, when a continuous casting pulling speed stabilizes, applying a pulse electric field to a molten steel in a tundish;

S2, setting an initial pulse voltage, an initial pulse current, and an initial pulse frequency in accordance with rare earth element content in the molten steel; the rare earth element content in the molten steel is 100-500 ppm; the pulse voltage is 10-100 V; the pulse current is 20-500 A; the pulse frequency is 1,000-100,000 Hz; specific details of setting an initial pulse voltage, an initial pulse current, and an initial pulse frequency in accordance with rare earth element content in the molten steel are as follows:

when the rare earth element content is 100-200 ppm, the initial pulse voltage is 10-20 V, the initial pulse current is 20-100 A, and the initial pulse frequency is 1,000-5,000 Hz;

when the rare earth element content is 200-300 ppm, the initial pulse voltage is 20-40 V, the initial pulse current is 60-140 A, and the initial pulse frequency is 5,000-10,000 Hz;

when the rare earth element content is 300-400 ppm, the initial pulse voltage is 40-60 V, the initial pulse current is 100-250 A, and the initial pulse frequency is 5,000-40,000 Hz;

when the rare earth element content is 400-500 ppm, the initial pulse voltage is 60-100 V, the initial pulse current is 200-500 A, and the initial pulse frequency is 10,000-100,000 Hz;

S3, according to a position change of a stopper rod during continuous casting, adjusting the pulse voltage, the pulse current and the pulse frequency in real-time until the continuous casting is complete, and then terminating the pulse electric field; the specific details of adjusting the pulse voltage, the pulse current, and the pulse frequency in real-time according to the position change of the stopper rod during continuous casting are as follows:

when the rare earth element content in the molten steel is 100-300 ppm, increasing the pulse voltage, the pulse current, and the pulse frequency by 30-50% when the position of the stopper rod rises by more than 6 mm within 20 minutes; when the position of the stopper rod rises by more than 8 mm within 35 minutes, increasing the pulse voltage, the pulse current, and the pulse frequency all by 40-80%;

when the rare earth element content in the molten steel is 300-400 ppm, increasing the pulse voltage, the pulse current, and the pulse frequency by 20-40% when the position of the stopper rod rises by more than 6 mm within 25 minutes; when the position of the stopper rod rises by more than 8 mm within 40 minutes, increasing the pulse voltage, the pulse current, and the pulse frequency all by 30-50%;

when the rare earth element content in the molten steel is 400-500 ppm, increasing the pulse voltage, the pulse current, and the pulse frequency by 20% when the position of the stopper rod rises by more than 6 mm within 25 minutes; when the position of the stopper rod rises by 8 mm within 40 minutes, increasing the pulse voltage, the pulse current, and the pulse frequency to an upper parameter range.

2. The method for improving running of casting of rare earth stainless steel using pulse current according to claim 1, characterized in that a material of the immersion nozzle in the step S1 is aluminum-carbon, aluminum-silicon-zirconium-carbon, or aluminum-zirconium-carbon.

3. The method for improving running of casting of rare earth stainless steel using pulse current according to claim 1, characterized in that the rare earth element in the step S2 is one or more of lanthanum, cerium, neodymium, and yttrium.

* * * * *